US006298820B1

(12) United States Patent
Borkowski

(10) Patent No.: US 6,298,820 B1
(45) Date of Patent: Oct. 9, 2001

(54) APPARATUS AND METHOD OF PROTECTING A WATER PUMP DRIVEN BY A COMBUSTION ENGINE FROM HIGH SPEED DAMAGE

(75) Inventor: Andrzej Borkowski, Esslingen (DE)

(73) Assignee: Mercedes Textiles Limited, Kirkland (CA)

( * ) Notice: Subject to any disclaimer, the term of this patent is extended or adjusted under 35 U.S.C. 154(b) by 0 days.

(21) Appl. No.: 09/702,526

(22) Filed: Oct. 31, 2000

(30) Foreign Application Priority Data

Nov. 9, 1999 (CA) ..... 2289343

(51) Int. Cl.[7] ..... F02F 77/00
(52) U.S. Cl. ..... 123/198 D; 123/198 DB; 123/198 C
(58) Field of Search ..... 123/198 D, 198 DC, 123/198 DB, 198 C

(56) References Cited

U.S. PATENT DOCUMENTS

| | | |
|---|---|---|
| 2,941,120 | 6/1960 | Harman et al. . |
| 3,259,826 | 7/1966 | Paul et al. . |
| 3,609,454 | 9/1971 | Capitanio . |
| 4,079,432 | 3/1978 | Godfrey . |
| 4,241,299 | 12/1980 | Bertone . |
| 4,393,966 | 7/1983 | Kono et al. . |
| 5,285,344 | 2/1994 | Heitzmann . |
| 5,455,469 | 10/1995 | Ward . |
| 5,951,258 | 9/1999 | Lueschow et al. . |
| 5,959,494 | 9/1999 | Fotouhi . |

*Primary Examiner*—Noah P. Kamen
(74) *Attorney, Agent, or Firm*—McCormick, Paulding & Huber LLP

(57) ABSTRACT

An apparatus and method for automatic shut-off of a combustion engine driving a fluid pump of a fluid displacement unit is presented. The apparatus and method are designed to protect the fluid displacement unit form damage due to excessively high running speeds by shutting off the combustion engine and to automatically reset the combustion engine for manual restart subsequent to the combustion engine spinning down to a rest.

16 Claims, 2 Drawing Sheets

APPARATUS AND METHOD OF PROTECTING A WATER PUMP DRIVEN BY A COMBUSTION ENGINE FROM HIGH SPEED DAMAGE

CROSS-REFERENCE TO RELATED APPLICATIONS

This is the first application filed for the present invention.

TECHNICAL FIELD

The invention relates to monitoring of operating conditions and control of unattended fluid displacement equipment and, in particular apparatus and methods of monitoring an operating speed of a fluid displacement unit comprising a fluid pump powered by a combustion engine are described.

BACKGROUND OF THE INVENTION

In the field of forest fire control one colloquially uses the term "portable water pump" to refer to a fluid displacement unit. For the purpose of clear presentation of the subject matter of this application the term "fluid displacement-unit" will be used instead of the general term "water pump" and kept distinct from a "fluid pump": a fluid displacement unit is an integral component adapted to convey water, the fluid displacement unit for forest fire control typically comprises a combustion engine driving a fluid pump.

In fire fighting, fluid displacement units are designed to operate unattended. The fluid displacement units typically convey water from a water store such as a lake. A fluid displacement unit conveys water from an input port such as a hose inserted in the lake to an output port such as a nozzle at and end of another hose. Operating characteristics of fluid displacement units are well established when the water supply at the input port is unlimited.

Water sources for forest fire fighting are sometimes limited in volume and when the water source is used up the fluid displacement units run dry. The closest water store to a forest fire is sometimes a slough or other limited store of water. Often the water in the water store is exhausted before the fire is put out or the fluid displacement unit is shut off. Typical operating characteristics of a fluid displacement unit when insufficient water is available to be drawn at the input port cannot be sustained for long periods of time without resulting damage to the fluid displacement unit.

The fluid pump and the combustion engine are designed to operate under load. Under load, water is conveyed through the fluid displacement unit. When insufficient water is available at the input port the load is decreased for the same torque provided by the combustion engine. The result is that the fluid pump develops a greater rotational speed and in turn the combustion engine tends to run at a higher speed. Higher running speeds induce heating in the mechanical components of the fluid pump and/or the combustion engine. Excessively high running speeds lead to excessive heating. Excessive heating results to damage to the parts of the fluid displacement unit by seizing either the fluid pump or the combustion engine.

It is known in the art to control rotational speed of combustion engines. There are numerous teachings of speed control enabling combustion engines to run at a predefined speed. These methods are unsuited for conveying of water since typically the cooling effects of the conveyed water onto the components of the fluid pump are taken into account in the design of fluid displacement units to minimize the production costs therefore leading to excessive heating when running dry. Other teachings call for operational speed monitoring and control allowing the fluid displacement unit to run at a lower idling speed when the water supply is insufficient at the intake port. Both of the above mentioned teachings are unsuited for the operation of a portable fluid displacement unit for forest fire control purposes since more often than not fuel resources are also limited and when water is not being pumped it is preferable that fuel resources be conserved. Current field practice utilizes methods of shutting off the combustion engine when the water supply is insufficient at the intake port.

Typically shutting off the engine involves a latching component which trips when an over speed condition in effect is sensed. To date, these latching components employ mechanical latching techniques and necessitate manual reset prior to restarting the combustion engine. More often than not ignorant and rookie/frustrated forest fire fighters omit resetting the latch and endlessly attempting to restart the combustion engine, often leading to flooding of the engine. Other rookie/frustrated fire fighters aware of the latching component block the action of the latching component in a position enabling operation of the fluid displacement unit under normal conditions but defeating the purpose of this protection against damage to the fluid displacement unit running at high speeds due to an insufficient supply of water at the intake port.

There is therefore a need for an apparatus and method for automatic shut-off of a combustion engine driving a fluid pump of a fluid displacement unit to protect the fluid displacement unit form damage and to automatically reset the combustion engine for manual restart subsequent to the combustion engine spinning down to a rest.

SUMMARY OF THE INVENTION

It is an object of the invention to provide a fluid displacement unit having a fluid pump driven by a combustion engine, the fluid displacement unit being adapted to automatically shut-off and reset in the absence of sufficient fluid at the fluid pump's intake port.

It is another object of the invention to enable the fluid displacement unit to react in real-time to the absence of sufficient fluid in the fluid pump's intake port to prevent damage to the combustion engine or the fluid pump.

It is a further object of the invention to provide an electrical circuit for automatically shutting off a combustion engine in the absence of sufficient fluid in the fluid pump's intake port, the circuit being adapted to reset after the combustion engine spins down to a rest.

It is a further object of the invention to provide a portable fluid displacement unit having a fluid pump driven by a combustion engine adapted to automatically shut-off and reset for a manual restart that is operative in restrictive elemental conditions such as are encountered in forest fire fighting.

It is a further object of the invention to provide a low power circuit adapted to: monitor the operating speed of the fluid displacement unit, shut-off and reset the combustion engine for a manual restart after the combustion engine has spun down to a rest.

It is yet another object of the invention to provide a method of monitoring the operating speed of the fluid displacement unit, shut-off and reset the combustion engine for a manual restart after the combustion engine has spun down to a rest.

According to one aspect of the invention, a method of automatically limiting an operating speed of a fluid displacement unit is provided. The fluid displacement unit has a fluid pump powered by a combustion engine. The automatic limiting of the operating speed of the fluid displacement unit is enabled by an automatic shut-off and reset control circuit. The automatic shutoff and reset control circuit provides a frequency acceptance window and an attention electrical signal. The method teaches a sequence of steps according to which: an input electrical signal is received by the automatic shut-off and reset control circuit. The input electrical signal is representative of the operation of the fluid displacement unit. The input electrical signal is cyclical in nature having a frequency representative of a current operating speed the fluid displacement unit. The input electrical signal also provides electrical power to the automatic shut-off and reset control circuit. The automatic shut-off and reset control circuit is enabled to store electrical power to drive its constituent components. The automatic shutoff and reset control circuit generates the frequency acceptance window which represents a range of allowable frequencies the input electrical signal can have. The frequency acceptance window has a maximum cut-off frequency representative of a maximum allowable operating speed of the fluid displacement unit can have. The automatic shut-off and reset control circuit also generates the attention electrical signal. The attention electrical signal is characterized by an increasing potential. The attention electrical signal is adapted to reach a shut-off threshold level potential over a period of time at least as long as one cycle of the input electrical signal when the frequency of the input electrical signal represents the maximum allowable operating speed of the fluid displacement unit. The automatic shut-off and reset control circuit selectively decreases the potential of the attention electrical signal to a minimum potential level to prevent the attention electrical signal from reaching the shut-off threshold level potential if the frequency of the input electrical signal is within the frequency acceptance window. Fuel ignition in the combustion engine is inhibited if the potential of the attention electrical signal exceeds the shut-off threshold level potential. Manual restart of the fluid displacement unit is provided by re-enabling fuel ignition in the combustion engine after the combustion engine has spun down to rest.

According to another aspect of the invention, a fluid displacement unit having a fluid pump driven by a combustion engine and an automatic shut-off and reset control circuit is provided. The automatic shut-off and reset control circuit receives from an induction coil associated with the combustion engine an input electrical signal representative of the operation of the fluid displacement unit. The automatic shut-off and reset control circuit has an electrical power store, a first electrical signal generator, a second electrical signal generator, a decision circuit, a latching circuit and a biased electrical switching component. The power store is supplied with electrical power from the input electrical signal and drives the components of the automatic shut-off and reset control circuit. The first electrical signal generator is adapted to generate the first electrical signal defining a frequency acceptance window. The frequency acceptance window represents a range of allowable operating speeds of the fluid displacement unit. The frequency acceptance window has a maximum cut-off frequency which represents the maximum allowable operating speed of the fluid displacement unit. The second electrical signal generator is adapted to generate an attention electrical signal. The attention electrical signal is characterized by an increasing potential. The attention electrical signal is adapted to reach a shut-off threshold level potential over a period of time at least as long as one cycle of the input electrical signal, when the input electrical signal represents the maximum allowable operating speed of the fluid displacement unit. The decision circuit is adapted to decrease the potential of the attention electrical signal to a minimum potential level if the frequency of the input electrical signal is within the frequency acceptance window. The latching component is adapted to: compare the attention electrical signal against the shut-off threshold level potential, trip when the attention electrical signal exceeds the shut-off threshold level potential and latch once tripped in a state in which a shut-off electrical signal is generated for as long as electrical power is provided to the latching circuit. The biased electrical switching component has a default deactivated state and an activated state. The biased electrical switching component is connected such that fuel ignition in the combustion engine is inhibited when the biased electrical switching component is activated by the shut-off electrical signal. The biased electrical switching component automatically resets to the default deactivated state in the absence of the shut-off electrical signal.

According to yet another aspect of the invention, an automatic shut-off and reset control circuit for limiting the operating speed of a combustion engine is provided. The combustion engine has an ignition coil providing an input electrical signal representative of the operation of the combustion engine. The automatic shutoff and reset control circuit has an electrical power store, a first electrical signal generator, a second electrical signal generator, a decision circuit, a latching circuit and a biased electrical switching component. The power store is supplied with electrical power from the input electrical signal and drives the components of the automatic shut-off and reset control circuit. The first electrical signal generator is adapted to generate the first electrical signal defining a frequency acceptance window. The frequency acceptance window represents a range of allowable operating speeds of the combustion engine. The frequency acceptance window has a maximum cut-off frequency which represents the maximum allowable operating speed of the combustion engine. The second electrical signal generator is adapted to generate an attention electrical signal. The attention electrical signal is characterized by an increasing potential. The attention electrical signal is adapted to reach a shut-off threshold level potential over a period of time at least as long as one cycle of the input electrical signal, when the input electrical signal represents the maximum allowable operating speed of the combustion engine. The decision circuit is adapted to decrease the potential of the attention electrical signal to a minimum potential level if the frequency of the input electrical signal is within the frequency acceptance window. The latching component is adapted to: compare the attention electrical signal against the shut-off threshold level potential, trip when the attention electrical signal exceeds the shut-off threshold level potential and latch once tripped in a state in which a shut-off electrical signal is generated for as long as electrical power is provided to the latching circuit. The biased electrical switching component has a default deactivated state and an activated state. The biased electrical switching component is connected such that fuel ignition in the combustion engine is inhibited when the biased electrical switching component is activated by the shut-off electrical signal. The biased electrical switching component automatically resets to the default deactivated state in the absence of the shut-off electrical signal.

According to another aspect of the invention the biased electrical switching component is connected across an ignition rail and an ignition return rail.

According to yet another aspect of the invention the biased electrical switching component is a solid state switch such as a transistor.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
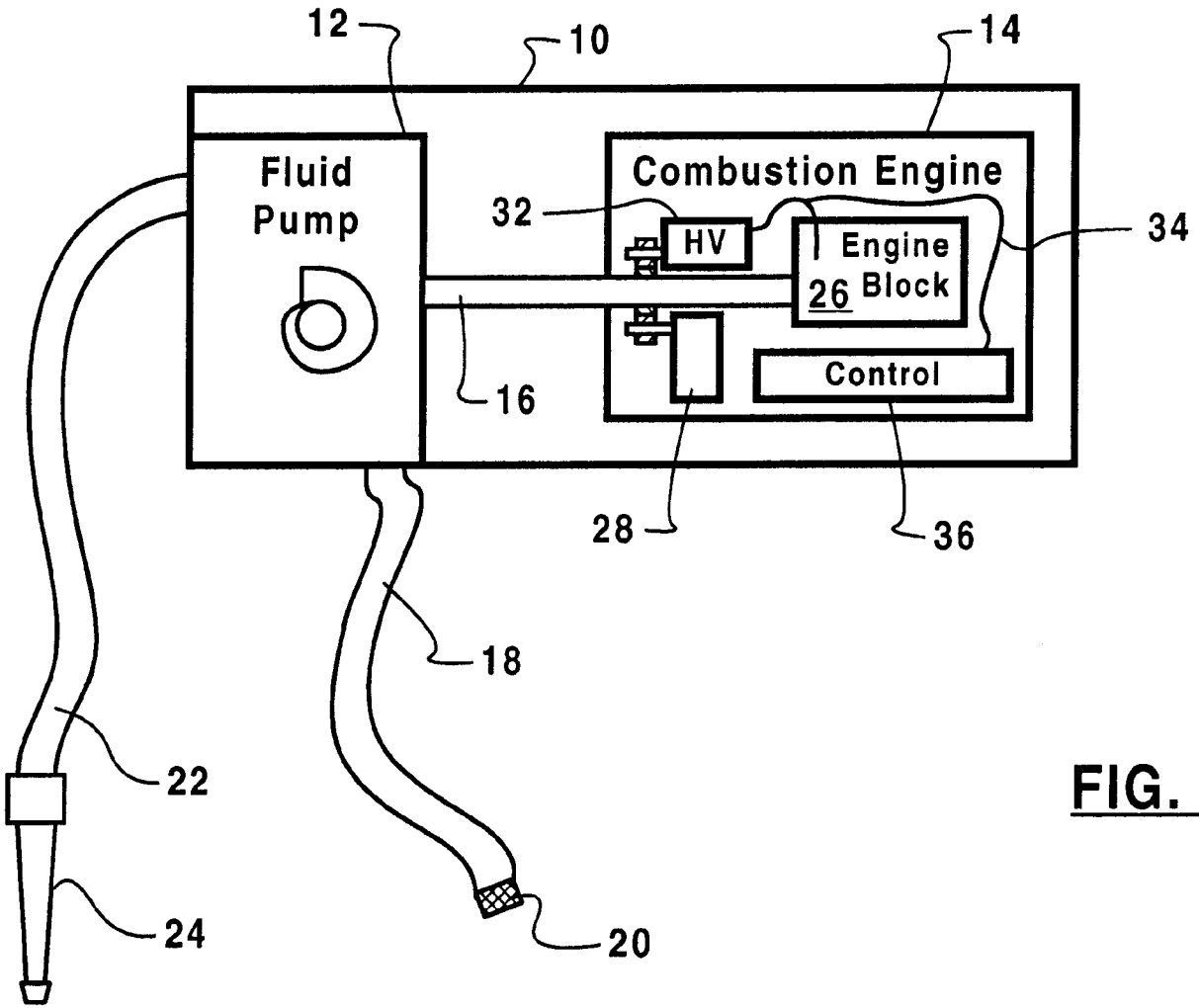
FIG. 1 is a schematic diagram showing, according to the invention, components of a fluid displacement unit.

FIG. 1 is a schematic diagram showing, according to the invention, components of a fluid displacement unit 10. The fluid displacement unit 10 has fluid pump 12 driven by a combustion engine 14 through a drive shaft 16.

The fluid pump 12 is adapted to convey a fluid, such as water. The fluid is received at the fluid pump 12 through a hose 18 having two ends. The hose 18 is connected at an end to the fluid pump 12 and is connected at the other end to a debris filter. The debris filtered end of the hose 18 represents an intake port 20 for the fluid pump 12. The fluid is delivered from the fluid pump 12 via another hose 22. The hose 22 is connected at an end to the fluid pump 12 and is connected at the other end to a nozzle 24 used in forest fire fighting.

The combustion engine 14 is adapted to be manually started, employing for example a pull string starter (not shown) operatively connected to a crank shaft (not shown). The combustion engine 14 has spark plugs (not shown) for enabling ignition of fuel in operating the combustion engine 14 and at least one induction coil providing a spark potential to create sparks during the operation of the combustion engine 14. To manually start the combustion engine 14: the pull string starter is used to rotate the crank shaft, the at least one induction coil creates the necessary ignition spark potential to ignite the fuel which takes over in driving the combustion engine 14 and the combustion engine 14 continues to operate on its own. One simple way to stop the combustion engine is to remove the ignition spark potential. One way of removing the ignition spark potential is to short the ignition coil output.

According the embodiment shown in FIG. 1, the combustion engine 14 has an induction coil 32 used to provide an ignition spark current delivered onto an ignition rail 34. The induction coil arrangement presented herein and with reference to this embodiment does not limit the scope of the invention and is only used for the purpose of illustrating the invention.

Figure 2:
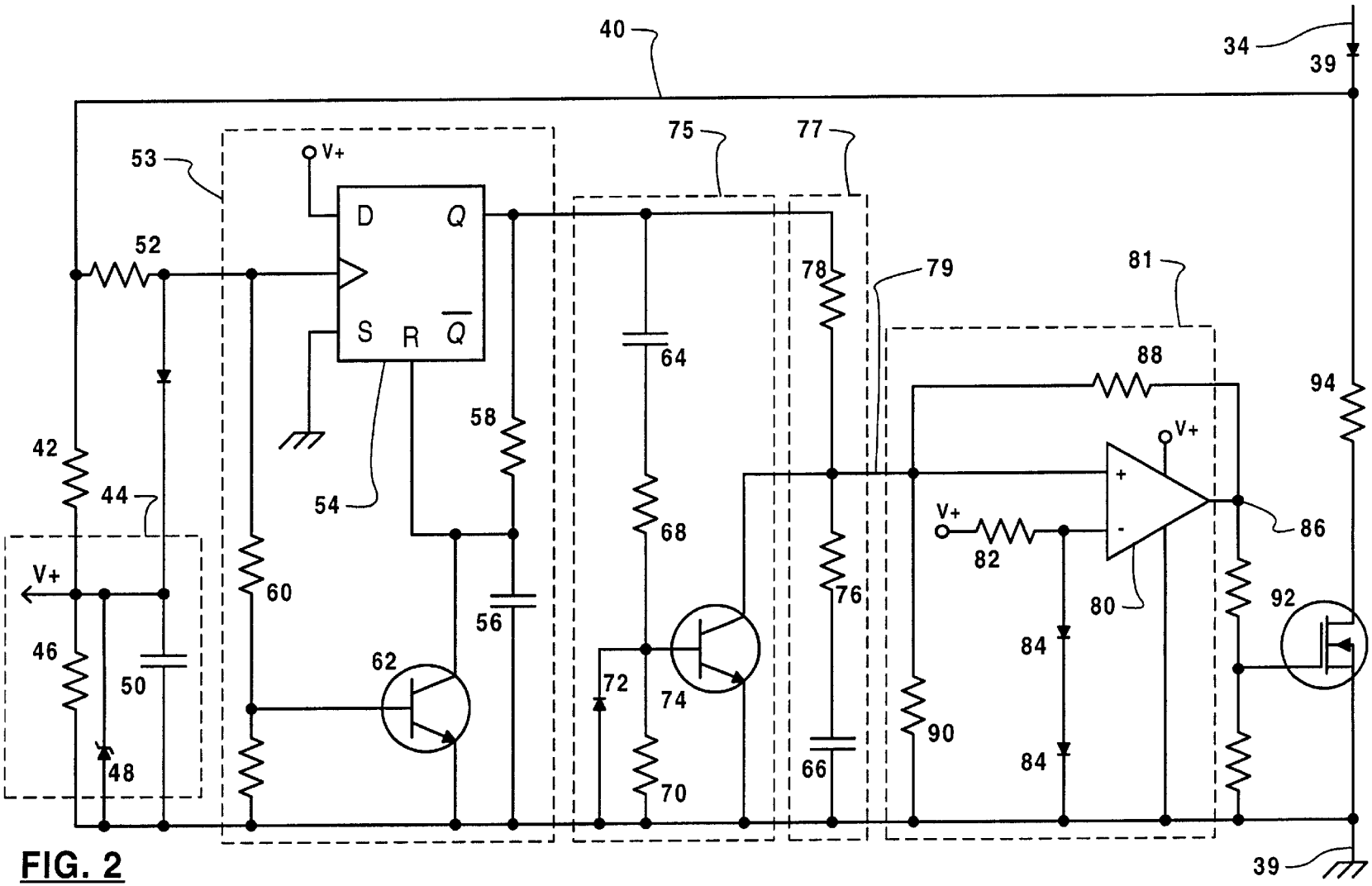
FIG. 2 is a circuit diagram showing, according to the invention, an automatic shut-off and reset control circuit.

According to the preferred embodiment, the combustion engine 14 is further adapted with an automatic shut-off and reset control circuit 36, referred to as the control circuit 36 hereinafter and shown in detail in FIG. 2. The control circuit 36 is connected to ignition rail 34 and a current return rail 38 which is typically a chassis of the fluid displacement unit 10. Return rail 38 is shown in FIG. 2 as chassis ground connections. The control circuit 36 receives an input electrical signal representative of the operation of the fluid displacement unit 10 extracted from rail 34. The operation of the control circuit 36 is sustained by the current provided by the input electrical signal. The operation of the control circuit 36 is dependent on the characteristics of the potential of the input electrical signal. Specifically the potential of the input electrical signal varies cyclically in time at a temporal frequency related to the rotation of the drive shaft 16 as will be understood by persons of ordinary skill in the art.

According to an implementation of the preferred embodiment, the control circuit 36, shown in FIG. 2, is adapted to derive power from the input electrical signal provided on rail 34. The input electrical signal provided by rail 34 has an alternating current waveform whose frequency is representative of a current operating speed of the fluid displacement unit 10. The diode 39 is used rectify the input electrical signal.

A rectified input electrical signal 40 is provided through a limiting resistor 42 to a voltage regulator circuit 44 comprised of a shunt resistor 46, a voltage defining Zener diode 48 and a power storing capacitor 50. The voltage regulator circuit 44 provides electrical power to the rest of the components of the control circuit 36. Electrical power provision is schematically shown by the "V+" label throughout the diagram.

According to an implementation of the preferred embodiment, the rectified input electrical signal 40 is provided as a clock signal through another limiting resistor 52 to a first signal generator 53 comprising: an SR flip-flop 54 having a data input D tied high and a set input S tied low, a capacitor 56 and a current limiting resistor 58. The SR flip-flop 54 is clocked on every cycle of the rectified input electrical signal 40. The SR flip-flop 54 is clocked at the current operating speed of the combustion engine 14.

On every clock cycle, the SR flip-flop 54 sets a non-inverting output Q to the logical value of the data input D. Since the data input D is tied high the Q input is set logic high on every cycle. Tied to the non-inverting output Q is the capacitor 56 drawing current from the non-inverting output Q through the limiting resistor 58, when the output Q is high. Capacitor 56 and the limiting registor 58 control the time period in which the capacitor 56 charges. Once this time period elapses, capacitor 56 is charged to the value of the supply voltage V+ which represents logic high. The capacitor 56 is also tied to a reset input R of the SR flip-flop 54. Once capacitor 56 charges, the reset input R is therefore driven high which resets the SR flip-flop 54 setting the non-inverting output Q to ground. As the non-inverting output Q sits at ground the capacitor 56 starts discharging through resistor 58. On a subsequent cycle of the input electrical signal, as the SR flip-flop 54 is clocked again, some current is provided through a resistor 60 to a transistor 62 connected across the capacitor 56 to speed up the discharging process before charging of the capacitor 56 ensues again.

Therefore for long consecutive cycles corresponding to a low current operating speed of the combustion engine 14, the non-inverting output 54 provides a waveform which is logic high for a fixed time period at the beginning of each cycle imposed by capacitor 56 and resistor 58. This fixed time period is chosen to be the period of one cycle corresponding to the maximum allowable operating speed of the first electrical signal generator provides a frequency acceptance window for frequencies of the input electrical signal corresponding to operating speeds below the maximum allowable operating speed of the combustion engine 14.

According to an implementation of the preferred embodiment, during the time that the non-inverting output Q of the SR flip-flop 54 is logic high, the non-inverting output Q provides a charging voltage to two capacitors 64 and 66. As capacitor 64 charges through limiting resistors 68 and 70, a base current is provided to transistor 74 enabling the transistor to conduct. As the capacitor 64 is charged up the base current to the transistor 74 is removed. The transistor 74 is connected across capacitor 66. Therefore as soon as the non-inverting output Q goes high, transistor 74 discharges capacitor 66 through resistor 76. The value of resistor 76 controls the time period in which the capacitor 66 discharges. A fast discharge of the capacitor 66 is preferred. Capacitor 64, resistor network 68, 70 and transistor 74 represent a decision circuit 75 adapted to discharge capacitor 66 if the frequency of the input electrical signal is within the acceptance frequency window imposed by the first signal generator 53

Therefore after the non-inverting output Q goes high, after the capacitor 64 charges up and after transistor 74 no longer conducts, the capacitor 66 starts charging through the resistor network 76, 78. The combined values of the resistors 76 and 78 control the time period in which the capacitor 66 charges. Compared to the time period in which the capacitor 66 discharges, a long charge time period is preferred (at least longer than one cycle of the frequency of the input electrical signal when the input electrical signal represents the maximum allowable operating speed of the combustion engine). More on the preferred length of the charge time period of capacitor 66 below. The capacitor 66 charges for as long as the non-inverting output Q of the SR flip-flop is logic high. Therefore capacitor 66 and resistor network 76, 78 represents a second signal generator 77. The second signal generator 77 is adapted to provide an attention electrical signal 79.

According to the invention, the characteristics of the control circuit 36 as described are such that as soon as the current operating speed of the combustion engine 14 becomes higher than the maximum allowable operating speed, perhaps due to insufficient water at the intake port 20 of fluid displacement unit 10, transistor 62 is driven into conduction before capacitor 56 has a chance to fully charge and the capacitor 56 is discharged. The non-inverting output Q therefore is latched logic high because the capacitor 56 does not charge fully and the SR flip-flop 54 is not reset from cycle to cycle of the input electrical signal. With the non-inverting output Q of the SR flip-flop 54 kept at logic high for a period of a few cycles, capacitor 66 has time to charge up driving the attention electrical signal 79 to higher and higher potential levels from cycle to cycle.

According to an implementation of the preferred embodiment, the potential level of the attention electrical signal 79 developed across capacitor 66 and resistor 76 is provided to a non-inverting input of a comparator 80 of a latching circuit 81. The comparator 80 is supplied at its inverting input with a threshold potential level provided by bleed resistor 82 and at least one series diode 84. As long as the voltage at the non-inverting input of the comparator 80 is kept below the inverting input of comparator 80, comparator 80 keeps an output 86 to ground. As soon as the comparator 80 is in a state in which the voltage at the non-inverting input becomes larger than the inverting input, the comparator 80 drives the output 86 logic high. As soon as the output 86 of the comparator 80 goes logic high a positive feedback resistor network made up of resistors 88 and 90 provides the necessary voltage at the non-inverting input to keep the comparator 80 latched in a state in which it provides a logic high at output 86. The comparator 80 is latched in a state in which it provides a logic high at output 86 for as long as there is power provided to the comparator 80 from the power storing capacitor 50 of the voltage regulator circuit 44. Driving the output 86 of the comparator 80 logic high provides a shut-off signal.

According to an implementation of the preferred embodiment, a biased electrical component such as a transistor 92 is driven into conduction as soon as the output 86 of the comparator 80 is driven logic high. Transistor 92, for as long as it is driven shunts rail 34 to chassis ground 38 through a current limiting resistor 94 therefore providing automatic shut-off of the combustion engine 14 if the current operating speed of the combustion engine 14 exceeds the maximum allowable operating speed.

With ignition rail 34 shunted to ground, the combustion engine 14 can no longer sustain ignition and spins down to rest. As the combustion engine 14 spins down to rest, the power storing capacitor 50 is no longer provided with power and is depleted by the latched components of the control circuit 36. The power storing capacitor is chosen such that it is depleted in a time period longer than that required for the combustion engine 14 to spin down to rest.

According to the invention, without power, the comparator 80 can no longer maintain output 86 at logic high. Transistor 92 is no longer provided with the necessary base current to conduct and no longer provides a shunt for the ignition rail 34 to ground therefore automatic reset is provided for the fluid displacement unit 10 after the combustion engine 14 has spun down to a rest.

According to the invention, a biased electrical switching component 92 is employed in effecting automatic control over the operation of the fluid displacement unit 10. The biased electrical switching component 92 has a default deactivated state and an activated state. The biased electrical switching component is operatively connected so as to selectively inhibit fuel ignition in the combustion engine 14 when activated by the shut-off signal. The biased electrical switching component 92 is connected across the ignition rail 34 and chassis ground 38 so that when activated, the ignition rail 34 is shunted thereby preventing ignition in the combustion engine 14. The biased feature of the biased electrical switching component 52 enables its automatic reset to the default deactivated state in the absence of the shut-off signal 50. As examples of biased electrical switching components there are: electromechanical relays, solid state relays, power transistors, etc.

An electromechanical relay is not preferred in a preferred implementation of the invention because, although less expensive, the electromechanical relay is prone to mechanical failure due to repetitive use and consumes a considerable amount of electrical power decreasing the efficiency of a portable type fluid displacement unit.

Should the portable and self-powered requirements be a non-issue, the use of relays can be enabled by an electrical power buffer such as a battery or a large capacitative network (not shown).

The embodiments of the invention described above are intended to be exemplary only. The scope of the invention is therefore intended to be limited solely by the scope of the appended claims.

I claim:

1. A method of automatically limiting an operating speed of a fluid displacement unit having a fluid pump powered by a combustion engine using an automatic shut-off and reset control circuit, the automatic shut-off and reset control circuit providing a frequency acceptance window and an attention electrical signal, the method comprising the steps of:

a) receiving an input electrical signal representative of the operation of the fluid displacement unit, the input electrical signal being cyclical in nature and having a frequency representative of a current operating speed of the fluid displacement unit;

b) deriving electrical power from the input electrical signal to be stored and to drive components of the automatic shut-off and reset control circuit;

c) generating the frequency acceptance window representative of a range of allowable frequencies of the input electrical signal, the frequency acceptance window having a maximum cut-off frequency representative of a maximum allowable operating speed of the fluid displacement unit;

d) generating the attention electrical signal characterized by an increasing potential, the attention electrical signal being adapted to reach a shut-off threshold level potential over a period of time at least as long as one cycle of the input electrical signal when the frequency of the input electrical signal represents the maximum allowable operating speed of the fluid displacement unit;

e) selectively decreasing the potential of the attention electrical signal to a minimum potential level preventing the attention electrical signal from reaching the shut-off threshold level potential if the frequency of the input electrical signal is within the frequency acceptance window;

f) selectively inhibiting fuel ignition in the combustion engine if the potential of the attention electrical signal exceeds the shutoff threshold level potential; and g) enabling manual restart of the fluid displacement unit by re-enabling fuel ignition in the combustion engine subsequent to the combustion engine spinning down to a rest.

2. A method of automatically limiting the operating speed of the fluid displacement unit as claimed in claim 1, wherein the step of selectively inhibiting fuel ignition in the combustion engine further comprises the steps of:

a) selectively providing a shut-off signal, for as long as electrical power is available to the automatic shut-off and reset control circuit, based on the potential of the attention electrical signal being greater than the shut-off threshold level potential; and b) activating a biased electrical switching component having a default deactivated state and an activated state, the biased electrical switching component being operatively connected so as to selectively inhibit fuel ignition in the combustion engine when activated by the shut-off signal.

3. A method of automatically limiting the operating speed of the fluid displacement unit as claimed in claim 2, wherein the stored electrical power is depleted in a period of time longer than that necessary for the combustion engine to spin down to rest.

4. A method of automatically limiting the operating speed of the fluid displacement unit as claimed in claim 2, wherein the step of enabling manual restart of the fluid displacement unit further comprises the step of:

a) automatically re-enabling fuel ignition in the combustion engine as the biased electrical component re-assumes the default deactivated state in the absence of the shut-off electrical signal as the stored electrical power is depleted.

5. A fluid displacement unit having a fluid pump driven by a combustion engine, an induction coil associated with the combustion engine, the fluid displacement unit comprising an automatic shut-off and reset control circuit receiving, from the induction coil associated with the combustion engine, an input electrical signal representative of the operation of the fluid displacement unit, the automatic shut-off and reset control circuit comprising an electrical power store, a first electrical signal generator, a second electrical signal generator, a decision circuit, a latching circuit and a biased electrical switching component; the power store being supplied with electrical power from the input electrical signal to drive the components of the automatic shut-off and reset control circuit, the shut-off and reset control circuit comprising;

a) the first electrical signal generator being adapted to generate a first electrical signal defining a frequency acceptance window representative of a range of allowable operating speeds of the fluid displacement unit, the frequency acceptance window being defined by a maximum cut-off frequency corresponding to a maximum allowable operating speed of the fluid displacement unit;

b) the second electrical signal generator being adapted to generate an attention electrical signal characterized by an increasing potential, the attention electrical signal being adapted to reach a shut-off threshold level potential over a period of time at least as long as one cycle of the input electrical signal when the input electrical signal represents a maximum allowable operating speed of the fluid displacement unit;

c) the decision circuit being adapted to decrease the potential of the attention electrical signal to a minimum potential level if the frequency of the input electrical signal is within the frequency acceptance window;

d) the latching circuit adapted to:

i) compare the attention electrical signal against the shut-off threshold level potential;

ii) trip when the attention electrical signal exceeds the shut-off threshold level potential; and iii) operatively latch, once tripped, in a state in which a shut-off electrical signal is generated for as long as electrical power is provided to the latching circuit; and e) the biased electrical switching component having a default deactivated state and an activated state, the biased electrical switching component being operatively connected so as to selectively inhibit fuel ignition in the combustion engine when activated by the shut-off electrical signal and automatically reset to the default deactivated state in the absence of the shut-off electrical signal.

6. A fluid displacement unit as claimed in claim 5, wherein the shut-off electrical signal persists for a period of time until the combustion engine has spun down to a rest.

7. A fluid displacement unit as claimed in claim 5, wherein the biased electrical switching component is connected across an ignition rail and a current return rail.

8. A fluid displacement unit as claimed in claim 5, wherein the biased electrical switching component is a solid state switch.

9. A fluid displacement unit as claimed in claim 8, wherein the solid state switch is a transistor.

10. A fluid displacement unit as claimed in claim 5, wherein the latching circuit is a positive feedback circuit driven by the attention electrical signal.

11. An automatic shut-off and reset control circuit for limiting an operating speed of a combustion engine having an ignition coil providing an input electrical signal representative of the operation of the combustion engine, the automatic shut-off and reset control circuit having an electrical power store, a first electrical signal generator, a second electrical signal generator, a decision circuit, a latching circuit and a biased electrical switching component; the power store deriving power from the input electrical signal to drive the components of the automatic shut-off and reset control circuit, the automatic shut-off and reset control circuit comprising;

a) the first electrical signal generator being adapted to generate a first electrical signal defining a frequency acceptance window representative of a range of allowable operating speeds of the combustion engine, the frequency acceptance window being defined by a maximum cut-off frequency corresponding to a maximum allowable operating speed of the combustion engine;

b) the second electrical signal generator being adapted to generate an attention electrical signal characterized by an increasing potential, the attention electrical signal being adapted to reach a shut-off threshold level potential over a period of time at least as long as one cycle of the input electrical signal when the input electrical signal represents a maximum allowable operating speed of the combustion engine;

c) the decision circuit being adapted to decrease the potential of the attention signal to a minimum potential level if the frequency of the input electrical signal is within the frequency acceptance window;

d) the latching circuit adapted to:

i) compare the attention electrical signal against the shut-off threshold level potential;

ii) trip when the attention electrical signal exceeds the shut-off threshold level potential; and iii) operatively latch, once tripped, in a state in which a shut-off electrical signal is generated for as long as electrical power is provided to the latching circuit; and e) the biased electrical switching component having a default deactivated state and an activated state, the biased electrical switching component being operatively connected so as to selectively inhibit fuel ignition in the combustion engine when activated by the shut-off electrical signal and automatically reset to the default deactivated state in the absence of the shut-off electrical signal.

12. An automatic shut-off and reset control circuit as claimed in claim 11, wherein the shut-off electrical signal persists for a period of time until the combustion engine has spun down to a rest.

13. An automatic shut-off and reset control circuit as claimed in claim 11, wherein the biased electrical switching component is connected across an ignition rail and a current return rail.

14. An automatic shut-off and reset control circuit as claimed in claim 11, wherein the biased electrical switching component is a solid state switch.

15. An automatic shut-off and reset control circuit as claimed in claim 14, wherein the solid state switch is a transistor.

16. An automatic shut-off and reset control circuit as claimed in claim 11, wherein the latching circuit is a positive feedback circuit driven by the attention electrical signal.

* * * * *